United States Patent [19]

Toryu et al.

[11] Patent Number: 4,458,484

[45] Date of Patent: Jul. 10, 1984

[54] CATALYTIC CONVERTER FOR EXHAUST GAS PURIFICATION

[75] Inventors: Kazuo Toryu; Katunori Higashi, both of Tokyo, Japan

[73] Assignee: Nissan Motor Company, Limited, Yokohama, Japan

[21] Appl. No.: 365,106

[22] Filed: Apr. 2, 1982

[30] Foreign Application Priority Data

Apr. 9, 1981 [JP] Japan ..... 56-52385

[51] Int. Cl.[3] ..... F01N 3/20

[52] U.S. Cl. ..... 60/284; 60/285

[58] Field of Search ..... 60/284, 285; 123/409

[56] References Cited

U.S. PATENT DOCUMENTS

| | | | |
|---|---|---|---|
| 3,441,381 | 4/1969 | Keith | 60/276 |
| 3,799,134 | 3/1974 | Griese | 60/285 |
| 3,813,877 | 6/1974 | Hunt | 60/284 |
| 3,896,913 | 7/1975 | Maruoka | 60/285 |
| 3,930,515 | 1/1976 | Kennedy | 123/409 |
| 3,964,258 | 6/1976 | Romano | 60/285 |
| 4,111,010 | 9/1978 | Minami | 60/284 |
| 4,112,891 | 9/1978 | Spaulding | 123/409 |

FOREIGN PATENT DOCUMENTS

| | | | |
|---|---|---|---|
| 2535354 | 2/1976 | Fed. Rep. of Germany | 123/409 |

*Primary Examiner*—Douglas Hart

*Attorney, Agent, or Firm*—Lane, Aitken & Kananen

[57] ABSTRACT

A catalytic converter is adapted to retard spark timing to increase the temperature of the converter catalyst when a temperature sensor within the converter senses low exhaust temperature. A vacuum advance mechanism is responsive to intake manifold vacuum conducted thereto via an intake vacuum passageway to advance spark timing for the engine. The temperature of exhaust gas from a catalytic converter for exhaust emissions is sensed. When the sensed temperature of the exhaust is below a predetermined value, a comparator outputs an actuation signal which is used to cause a solenoid valve to open an air passageway to admit atmospheric air into the vacuum advance mechanism so that spark timing will be retarded, thereby increasing the temperature of the catalyst. At least one of a transmission neutral switch, a throttle switch and a clutch switch connected in series may be provided in the circuit between the comparator and the solenoid valve for returning spark timing to a standard value when any of the switches is open. At least one of the intake vacuum passageway and the air passageways may be provided with a member for restricting the internal cross-sectional area of the associated passageway to obtain the desired spark timing relationship.

14 Claims, 2 Drawing Figures

CATALYTIC CONVERTER FOR EXHAUST GAS PURIFICATION

BACKGROUND OF THE INVENTION

The present invention relates to a catalytic converter for exhaust gas purification employed in an automotive vehicle internal combustion engine, and more particularly to an apparatus for warming up of the catalyst in the converter.

Conventional automotive vehicle engines are provided with a catalytic converter in the exhaust passageway. The converter efficiency is low when the temperature of the catalyst is low. Thus spark timing is retarded to increase the exhaust temperature, thereby warming up the catalyst sufficiently. For example, in a conventional automotive vehicle engine, intake vacuum is conducted from a vacuum inlet near the throttle valve in the air intake passageway through a vacuum passageway to a vacuum advance mechanism of the distributor. On the other hand, an atmospheric air introduction passageway is provided so as to communicate with an intermediate point in the vacuum passageway, and has a bimetallic valve responsive to the temperature of engine coolant. The bimetallic valve deforms to open the atmospheric air introduction passageway and introduce atmospheric air into the vacuum advance mechanism to retard the spark timing when the temperature of the coolant is relatively low, whereas the bimetallic valve deforms to close the atmospheric air introduction passageway when the temperature of the cooling water is relatively high.

However, this warm-up function has previously been effected dependent on the coolant temperature of the engine, and has had nothing to do with the actual state of the catalytic converter. Thus, the conventional apparatus has the following drawbacks:

(1) Even if the catalytic converter is already warmed up, spark timing may be unnecessarily retarded and as a result, fuel will be consumed uselessly; and (2) During extended vehicle operation at low speeds, the catalyst may be insufficiently warm so that harmful exhaust emissions will be produced even though the temperature of the coolant is sufficient to prevent retardation of spark timing.

SUMMARY OF THE INVENTION

Means is provided for sensing the temperature of the catalyst in a catalytic converter for exhaust emissions. When the sensed temperature is below a predetermined value as determined by a comparator, an actuation signal is produced which causes atmospheric air to be conducted to a vacuum advance mechanism in order to retard spark timing, thereby increasing the temperature of the catalyst.

Thus, irrespective of engine coolant temperature, spark timing is retarded to expedite warm-up of the catalytic converter until the catalytic converter is fully warmed up. This reduces the amount of harmful exhaust emissions. After the catalytic converter has completely warmed up, excessive retardation of spark timing is abruptly stopped, preventing unnecessary fuel waste.

At least one of a transmission neutral switch, a throttle switch and a clutch switch connected in series may be provided in the circuit between the comparator and the solenoid valve to return spark timing to a standard value when any of the switches is off.

At least one of the intake vacuum passageway and the air passageways may be provided with a member for restricting the internal cross-sectional area of at least one of the passageways to obtain a desired spark timing.

BRIEF DESCRIPTION OF THE DRAWINGS

Features and advantages of the present invention will be apparent from the following description of a preferred embodiment thereof, taken in conjunction with the accompanying drawings in which.

DETAILED DESCRIPTION OF THE PREFERRED EMBODIMENTS

Figure 1:
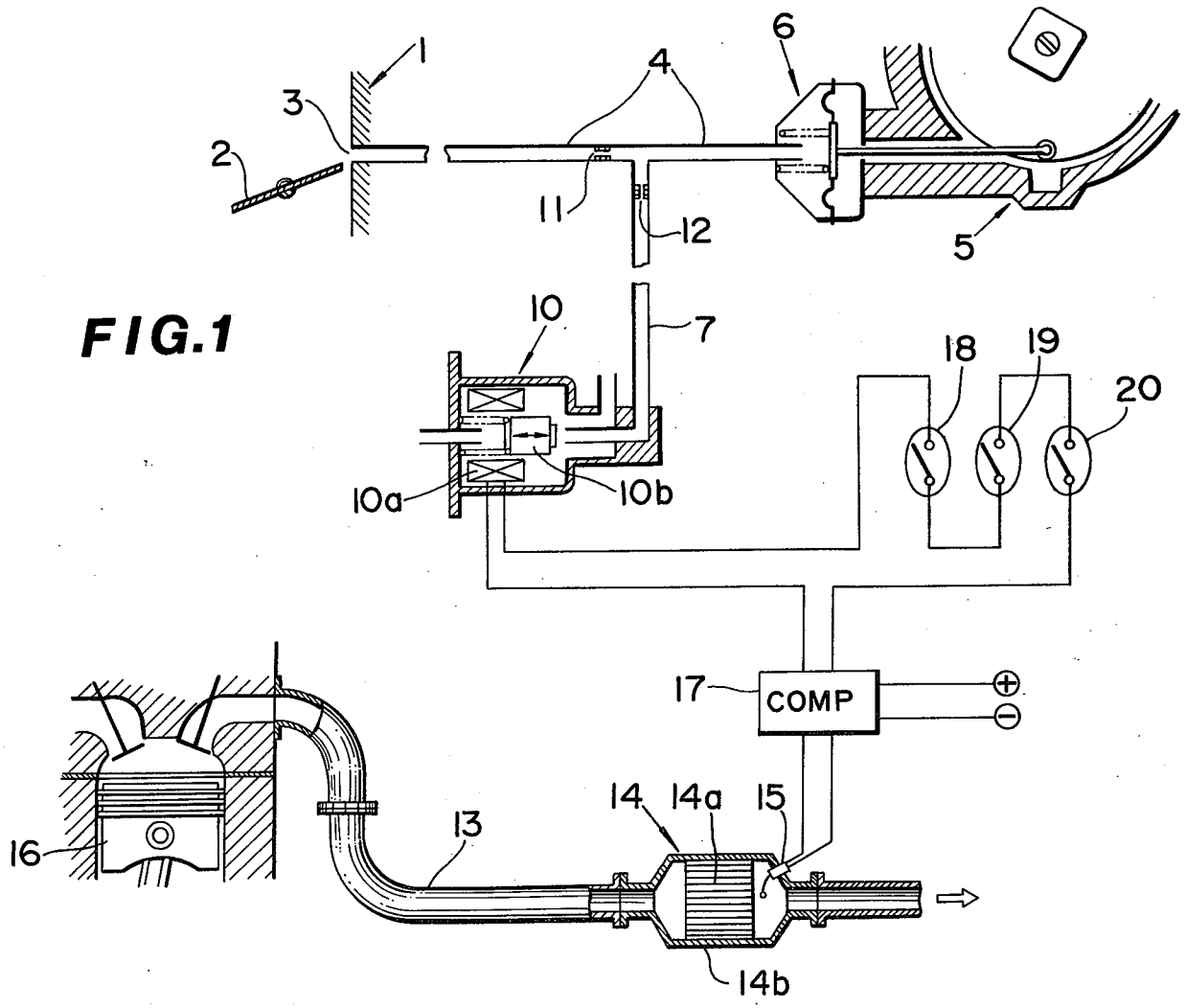
FIG. 1 is a diagrammatic view of a preferred embodiment of a catalyst warm-up apparatus according to the present invention.

Referring to FIG. 1, there is shown a catalyst warm-up apparatus according to the present invention. Vacuum is taken up from an inlet 3 provided near a throttle valve 2 in the intake manifold of a carburetor 1. The vacuum is then conducted via a vacuum passageway 4 to a vacuum advance mechanism 6 of a distributor 5. As the vacuum becomes stronger, the spark timing is advanced. An atmospheric air introduction passageway 7 joins the vacuum passageway 4 at an intermediate point and is provided with a normally closed electromagnetic valve 10. The vacuum passageway 4 may be provided with a throttle orifice 11 between the inlet 3 and the intermediate point where the atmospheric passageway 7 joins the vacuum passageway 4. The atmospheric passageway 7 may also be provided with a throttle orifice 12.

A catalytic converter 14, disposed along an exhaust passageway 13 leading from an engine 16, consists of a catalyst **14*a* housed in a casing 14*b*. A temperature sensor 15, which may be a thermocouple or thermister, is provided just downstream of the catalyst 14*a* of the catalytic converter 14. The output terminal of the sensor 15 is connected to a comparator 17 which receives a signal indicative of the temperature sensed by the temperature sensor 15 and outputs a high level voltage when the exhaust temperature just downstream of the catalyst is below a predetermined value, for example 300° C. The output terminal of the comparator 17 is connected in series with a neutral switch 18, a throttle switch 19, a clutch switch 20** and an energizing coil lO*a* of the electromagnetic valve 10. The neutral switch 18 is open when the transmission shift lever is in the neutral position and closed otherwise. The throttle switch 19 is open when the throttle valve 2 is completely closed and closed otherwise. The clutch switch 20 is open when the clutch pedal is depressed and closed otherwise.

In operation, the temperature sensor 15 senses the temperature of exhaust emissions just downstream of the catalyst **14*a* of the catalytic converter 14. When the temperature of exhaust emissions is low and the warm-up of the catalyst is determined to be not completed, the comparator 16 energizes the coil 10*a* of the electromagnetic valve 10 to cause a valve member 10*b* to move to the left in FIG. 1. This opens the atmospheric passageway 7, thereby admitting the atmospheric air into the vacuum advance mechanism 6. As a result, the spark timing is retarded and the temperature of exhaust emissions rises, thereby expediting the warm-up of the catalytic converter 14**.

When, on the other hand, the temperature of exhaust emissions is high and the catalyst is determined to be completely warmed up, the energizing coil 10*a* of the electromagnetic valve 10 is deenergized so that the valve member 10*b* moves to the right, thereby closing the atmospheric passageway 7. This prevents the atmospheric air from entering the vacuum advance mechanism 6, thereby returning the spark timing to the standard value.

(1) When the transmission shift lever is in the neutral position so that switch 18 is open, (2) when the throttle valve 2 is completely closed so that switch 19 is open, or (3) when the clutch pedal is depressed so that switch 20 is open, the output of the comparator 17 to the electromagnetic valve 10 is shut off even if the catalyst is not completely warmed up so that the spark timing returns to the standard value. Thus, in case (1), satisfactory start-up and post-start stability of the engine are ensured; in case (2), the stability of the engine during idling is ensured; and, in case (3), satisfactory start-up and post-start stability of the engine when the engine is started with the clutch depressed and with the transmission shift lever in a position other than the neutral position is ensured.

Figure 2:
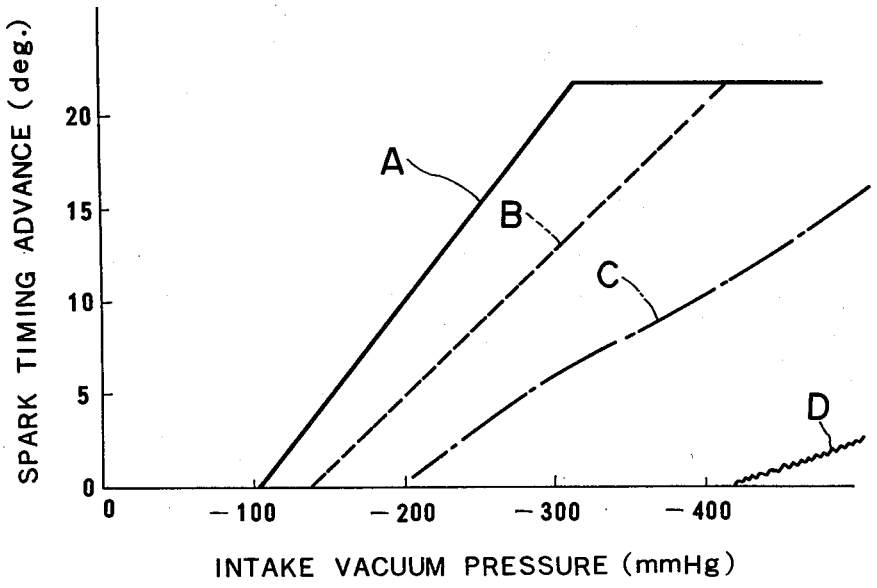
FIG. 2 is a graphic illustration of intake vacuum versus spark advance angle.

Appropriate selection of the diameters of the throttle orifices 11 and 12 determines spark timing when the warm-up of the catalyst is not completely finished and so atmospheric air is admitted into the atmospheric air passageway 7, as shown in FIG. 2. In more detail, if the internal diameters of the throttle orifices 11 and 12 are designated a and b, respectively, reference character A shows the relationship (independent of a and b) between the vacuum at the inlet 3 and spark timing when the atmospheric air is not admitted into the passageway 7; the reference character B shows the corresponding relationship when $a>b$ when the atmospheric air is admitted into the passageway 7; the reference character C shows the corresponding relationship when $a=b$ when the atmospheric air is admitted into the passageway 7; and the reference character D shows the corresponding relationship when $a<b$ when the atmospheric air is admitted into the passageway 7.

Thus, the deteriorated stability of the engine due to excessive retardation of spark timing when the catalyst is not completely warmed up is prevented, and an intermediate spark timing value expediting warm-up of the catalystic converter is ensured.

While the present invention has been described in terms of a preferred embodiment thereof, it should not be considered that the present invention is limited to the embodiment. Various changes and modifications could be made by those skilled in the art without departing the scope and spirit of the present invention as set forth in the attached claims.

What is claimed is:

1. Apparatus for warming up the catalyst of a catalytic converter provided in the exhaust passageway of an internal combustion engine with a vacuum advance mechanism responsive to intake vacuum to the engine for controlling engine spark timing, comprising:

(a) means for sensing the temperature of exhaust emissions just downstream of the catalyst;

(b) means responsive to the sensed temperature when the sensed temperature is below a predetermined value for outputting an actuation signal;

(c) means responsive to the actuation signal for admitting atmospheric air to said vacuum advance mechanism to retard spark timing, thereby expediting warming-up of the catalyst; and (d) at least one of a transmission neutral switch, a throttle switch and a clutch pedal switch connected in series between said actuation signal outputting means and said atmospheric air admitting means for preventing admission of atmospheric air to said vacuum advance mechanism when any of said switches is open, said neutral switch being open solely when the transmission is in its neutral position, said throttle switch being open solely when the throttle valve is completely closed, and said clutch switch being open solely when the clutch pedal is depressed further than a predetermined extent.

2. Apparatus as claimed in claim 1, wherein said atmospheric air admitting means includes a solenoid valve disposed between said atmospheric air admitting means and said vacuum advance mechanism.

3. Apparatus as claimed in claim 1 or 2, wherein said vacuum advance mechanism is provided with a first passageway to conduct intake vacuum thereto, a second passageway to conduct atmospheric air thereto, at least one of said first and second passageways having means for restricting the internal cross-sectional area thereof to a degree resulting in a predetermined relationship between spark timing and vacuum pressure at the vacuum advance mechanism.

4. Apparatus for warming up the catalyst of a catalytic converter provided in the exhaust passageway of an internal combustion engine, comprising:

means for detecting the temperature of the exhaust gas downstream of said catalyst, means responsive to said detecting means for retarding the spark timing of said engine when the temperature of the exhaust gas is below a predetermined value, and at least one of a transmission neutral switch, a throttle switch, and a clutch pedal switch connected in series between said detecting means and said retarding means for preventing response of said retarding means to said detecting means when any of said switches is open, said neutral switch being open solely when the transmission is in its neutral position, said throttle switch being open solely when the throttle valve is completely closed, and said clutch switch being open solely when the clutch pedal is depressed further than a predetermined extent.

5. Apparatus as claimed in claim 4, wherein said detecting means is a temperature sensor which is located in the casing of said catalytic converter.

6. Apparatus for warming up the catalyst of a catalytic converter provided in the exhaust passageway of an internal combustion engine, comprising:

means for detecting the temperature of the exhaust gas downstream of said catalyst, means responsive to said detecting means for retarding the spark timing of said engine when the temperature of the exhaust gas is below a predetermined value, and means for sensing the load on the engine and for preventing response of said retarding means to said detecting means when there is essentially no load on the engine.

7. Apparatus as claimed in claim 6, wherein said sensing means includes a transmission neutral switch connected in series between said detecting means and said retarding means, said switch being open solely when a transmission of the engine is in its neutral position.

8. Apparatus as claimed in claim 6, wherein said sensing means includes a throttle switch connected in series between said detecting means and said retarding means, said switch being open solely when a throttle valve of the engine is completely closed.

9. Apparatus as claimed in claim 6, wherein said sensing means includes a clutch pedal switch connected between said detecting means and said retarding means, said switch being open solely when a clutch pedal is depressed further than a predetermined extent.

10. Apparatus for warming up the catalyst of a catalytic converter provided in the exhaust passageway of an internal combustion engine, comprising:

means for detecting the temperature of the exhaust gas downstream of said catalyst, means responsive to said detecting means for retarding the spark timing of said engine when the temperature of the exhaust gas is below a predetermined value, and means for sensing the operating state of the engine and for preventing response of said retarding means to said detecting means during engine start-up and after engine start-up until engine output power is applied to drive the vehicle.

11. Apparatus as claimed in claim 10, wherein said sensing means includes a transmission neutral switch connected in series between said detecting means and said retarding means, said switch being open solely when a transmission of the engine is in its neutral position.

12. Apparatus as claimed in claim 10, wherein said sensing means includes a clutch pedal switch connected in series between said detecting means and said retarding means, said switch being open solely when a clutch pedal is depressed further than a predetermined extent.

13. Apparatus for warming up the catalyst of a catalytic converter provided in the exhaust passageway of an internal combustion engine, comprising:

means for detecting the temperature of the exhaust gas downstream of said catalyst, means responsive to said detecting means for retarding the spark timing of said engine when the temperature of the exhaust gas is below a predetermined value, and means for sensing the operating state of the engine and for preventing response of said retarding means to said detecting means when the engine is idling.

14. Apparatus as claimed in claim 13, wherein said sensing means includes a throttle valve switch connected in series between said detecting means and said retarding means, said switch being open solely when a throttle valve of the engine is completely closed.

* * * * *